US011837398B2

(12) United States Patent
Wang et al.

(10) Patent No.: US 11,837,398 B2
(45) Date of Patent: Dec. 5, 2023

(54) THIN-FILM INDUCTOR DEVICE

(71) Applicant: CHILISIN ELECTRONICS CORP., Taoyuan (TW)

(72) Inventors: Tim Wang, Kaohsiung (TW); Hung-Pin Lin, Kaohsiung (TW)

(73) Assignee: CHILISIN ELECTRONICS CORP., Taoyuan (TW)

( * ) Notice: Subject to any disclaimer, the term of this patent is extended or adjusted under 35 U.S.C. 154(b) by 489 days.

(21) Appl. No.: 16/991,617

(22) Filed: Aug. 12, 2020

(65) Prior Publication Data

US 2021/0343471 A1 Nov. 4, 2021

(30) Foreign Application Priority Data

Apr. 29, 2020 (TW) ..... 109114357

(51) Int. Cl.
*H01F 27/29* (2006.01)
*H01F 17/04* (2006.01)
*H01F 27/32* (2006.01)

(52) U.S. Cl.
CPC ..... *H01F 27/292* (2013.01); *H01F 17/045* (2013.01); *H01F 27/324* (2013.01)

(58) Field of Classification Search
CPC ..... H01F 27/292; H01F 17/045; H01F 27/324
See application file for complete search history.

(56) References Cited

U.S. PATENT DOCUMENTS

2010/0045398 A1* 2/2010 Liu ..... H01F 17/0013 333/25
2013/0222101 A1* 8/2013 Ito ..... H01F 3/08 336/83
2016/0055954 A1* 2/2016 Huang ..... H01F 17/06 336/83
2016/0078986 A1* 3/2016 Yoon ..... H01F 5/04 336/83
2016/0078994 A1* 3/2016 Yoon ..... H01F 5/00 336/200
2016/0078995 A1* 3/2016 Yoon ..... H01F 17/0013 336/200
2019/0096564 A1* 3/2019 Park ..... H01F 27/292
2020/0075219 A1* 3/2020 Matsumoto ..... H01F 27/2852
2020/0411232 A1* 12/2020 Matsumoto ..... H01F 27/327
2021/0134509 A1* 5/2021 Park ..... H01F 41/041
2021/0134515 A1* 5/2021 Jung ..... H01F 27/2804
2021/0134521 A1* 5/2021 Jung ..... H01F 27/24
2021/0233703 A1* 7/2021 Jung ..... H01F 27/24

* cited by examiner

*Primary Examiner* — Marlon T Fletcher
*Assistant Examiner* — Malcolm Barnes
(74) *Attorney, Agent, or Firm* — CKC & Partners Co., LLC

(57) ABSTRACT

A thin-film inductor device includes a substrate made of an electrically insulating material, a first coil unit, a second coil unit, and an inductance-enhancing structure. The first coil unit includes a first upper coil, a first lower coil, and two first electrodes electrically connected to the first upper and lower coils, respectively. The second coil includes a second upper coil, a second lower coil, and two second electrodes electrically connected to the second upper and lower coils, respectively. The first and second upper/lower coils are disposed spacedly and arranged by bifilar winding. The inductance-enhancing structure encapsulates the substrate, the first coil unit, and the second coil unit such that two terminal parts of each of the first electrodes and the second electrodes are exposed for external electrical connection.

20 Claims, 3 Drawing Sheets

THIN-FILM INDUCTOR DEVICE

CROSS-REFERENCE TO RELATED APPLICATION

This application claims priority of Taiwanese Invention Patent Application No. 109114357, filed on Apr. 29, 2020.

FIELD

This disclosure relates to an electronic device including a passive component, and more particularly to a thin-film inductor device.

BACKGROUND

With advancement of technology, there has been a trend to develop electronic devices that are lightweight and thin. To meet such requirements, various passive components installed in the electronic devices (e.g., resistors, capacitors, or inductors) need to be miniaturized.

In the early days, inductors were made by winding a wire around a magnetic body. The later developed inductors with smaller sizes generally include a coil unit, an encapsulation structure made of a magnetic material, and a plurality of electrodes disposed on side surfaces of the encapsulation structure for external electrical connection. The coil unit includes a plurality of coil layers, and is embedded in the encapsulation structure. Each coil layer is electrically connected to a respective one of the electrodes. When an external power supply is connected to the electrodes for providing current, a coupled inductance might be formed due to mutual inductance between two adjacent ones of the coil layers. Development of the semiconductor packaging industry has reduced the size of the coil unit and the encapsulation structure to a certain degree, thereby allowing miniaturization of the inductors. However, the reduction of coil width of the coil unit might inevitably increase the resistance thereof, causing the inductors to overheat during operation. In addition, the coils having a reduced width might be prone to breakage during manufacture of the inductors, which might adversely affect the properties and yields of the inductors.

SUMMARY

Therefore, an object of the disclosure is to provide a thin-film inductor device that can alleviate or eliminate at least one of the drawbacks of the prior art.

According to the disclosure, the thin-film inductor device includes a substrate, a first coil unit, a second coil unit, and an inductance-enhancing structure.

The substrate is made of an electrically insulating material, and has opposite upper and lower surfaces.

The first coil unit is made of an electrically conductive material, and includes a first upper coil, a first lower coil, and two first electrodes. The first upper coil and the first lower coil are formed on the upper surface and the lower surface of the substrate, respectively. The two first electrodes are spaced apart from each other, and electrically connect to the first upper and lower coils, respectively.

The second coil unit is made of an electrically conductive material, and includes a second upper coil, a second lower coil, and two second electrodes. The second upper coil and the second lower coil are formed on the upper surface and the lower surface of the substrate, respectively. The second upper coil and the first upper coil are disposed spacedly and arranged by bifilar winding. The second lower coil and the first lower coil are disposed spacedly and arranged by bifilar winding. The two second electrodes are spaced apart from each other, and electrically connect to the second upper and lower coils, respectively.

The inductance-enhancing structure encapsulates the substrate, the first coil unit, and the second coil unit, such that two terminal parts of each of the first electrodes and the second electrodes are exposed for external electrical connection.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
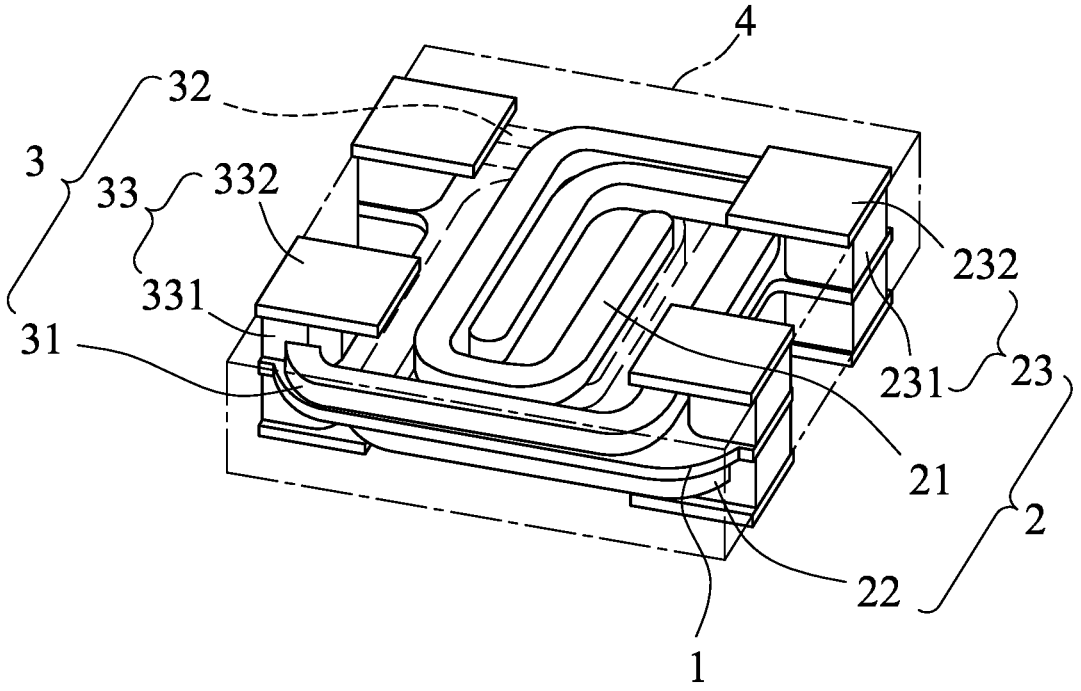
FIG. 1 is a perspective view illustrating a first embodiment of a thin-film inductor device according to the disclosure.

Before the disclosure is described in greater detail, it should be noted that where considered appropriate, reference numerals have been repeated among the figures to indicate corresponding or analogous elements, which may optionally have similar characteristics.

Figure 2:
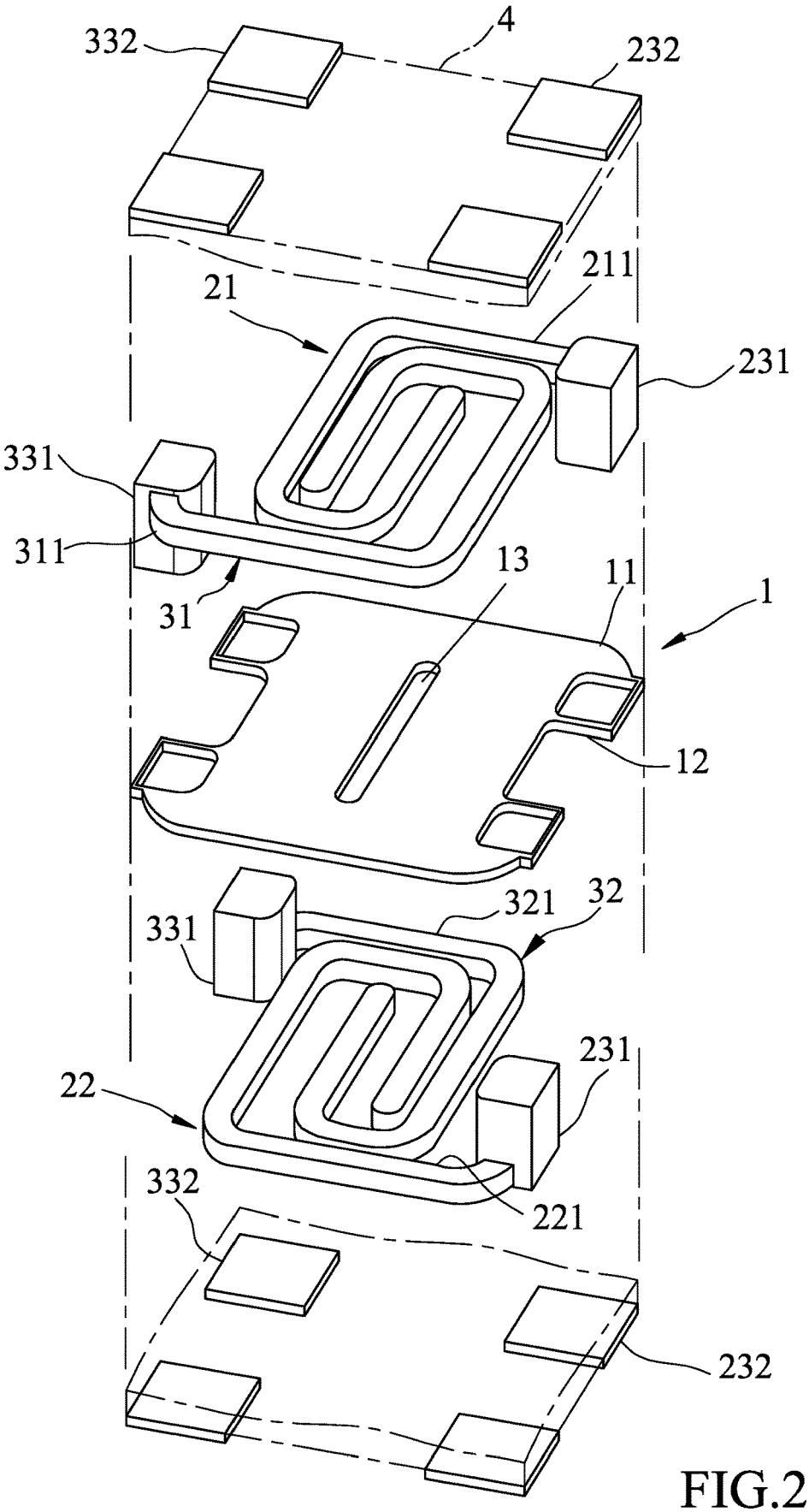
FIG. 2 is an exploded perspective view of the first embodiment of the thin-film inductor device.

Referring to FIGS. 1 and 2, a first embodiment of a thin-film inductor device includes a substrate 1, a first coil unit 2, a second coil unit 3, and an inductance-enhancing structure 4.

The substrate 1 has opposite upper and lower surfaces 11, 12, and is made of an electrically insulating material, such as a flame-retardant glass-reinforced epoxy board (FR-4) and polyimide (PI). The substrate 1 may have a thickness ranging from 15 μm to 25 μm. In this embodiment, the substrate 1 is formed with at least one through hole 13 in the center of the substrate 1 and two recesses extending inwardly from two opposite sides of the substrate 1.

The first coil unit 2 is made of an electrically conductive material, and includes a first upper coil 21 formed on the upper surface 11 of the substrate 1, a first lower coil 22 formed on the lower surface 12 of the substrate 1, and two first electrodes 23 spaced apart from each other, and electrically connecting to the first upper and lower coils 21, 22, respectively.

Each of the first upper and lower coils 21, 22 may have a width ranging from 5 μm to 150 μm, and a thickness ranging from 10 μm to 200 μm. Each of the first upper and lower coils 21, 22 may have a plurality of turns, and two adjacent ones of the turns are spaced apart from each other by a spacing that may range from 5 μm to 30 μm.

In certain embodiments, one of the first upper and lower coils 21, 22 may be wound in a clockwise direction starting from the first electrode 23, and the other one of the first upper and lower coils 21, 22 may be wound in a counterclockwise direction.

Each of the first electrodes 23 includes a first pillar 231 that penetrates the substrate 1 and that has two terminal parts for external electrical connection. Each of the first electrodes 23 may further include two first connection ports 232 that are respectively disposed on and electrically connected to the two terminal parts of the first pillar 231. In this embodiment, each of the first pillars 231 of the first electrodes 23 penetrates a first side portion of the substrate 1 adjacent to one of the two recesses of the substrate 1. One of the first pillars 231 is connected to a terminal end portion 211 of the first upper coil 21, and the other one of the first pillars 231 is connected to a terminal end portion 221 of the first lower coil 22.

Likewise, the second coil unit 3 is made of an electrically conductive material, and includes a second upper coil 31 formed on the upper surface 11 of the substrate 1, a second lower coil 32 formed on the lower surface 12 of the substrate 1, and two second electrodes 33 spaced apart from each other, and electrically connecting to the second upper and lower coils 31, 32, respectively. The second upper coil 31 and the first upper coil 21 are disposed spacedly and arranged by bifilar winding. Similarly, the second lower coil 32 and the first lower coil 22 are disposed spacedly and arranged by bifilar winding.

Each of the second upper and lower coils 31, 32 may have a width ranging from 5 μm to 150 μm, and a thickness ranging from 10 μm to 200 μm. Each of the second upper and lower coils 31, 32 may have a plurality of turns, and two adjacent ones of the turns are spaced apart from each other by a spacing ranging from 5 μm to 30 μm.

In certain embodiments, one of the second upper and lower coils 31, 32 may be wound in a clockwise direction starting from the second electrode 33, and the other one of the second upper and lower coils 31, 32 may be wound in a counterclockwise direction.

Each of the second electrodes 33 includes a second pillar 331 that penetrates the substrate 1 and that has two terminal parts for external electrical connection. Each of the second electrodes 33 may further include two second connection ports 332 that are respectively disposed on and electrically connected to the two terminal parts of the second pillar 331. In this embodiment, each of the second pillars 331 of the second electrodes 33 penetrates a second side portion of the substrate 1 that is opposite to the first side portion and that is adjacent to the other one of the two recesses of the substrate 1. One of the second pillars 331 is connected to a terminal end portion 311 of the second upper coil 31, and the other one of the second pillars 331 is connected to a terminal end portion 321 of the second lower coil 32.

In this embodiment, a projection of the first upper coil 21 on the substrate 1 is a mirror image of a projection of the second lower coil 32 on the substrate 1, and the two projections overlap with each other. Similarly, a projection of the first lower coil 22 on the substrate 1 is a mirror image of a projection of the second upper coil 31 on the substrate 1, and the two projections overlap with each other. Therefore, when an electric current flowing through the first coil unit 2 has the same value as an electric current flowing through the second coil unit 3, the first inductance generated by the first coil unit 2 and the second inductance generated by the second coil unit 3 will have similar values but in opposite directions.

The inductance-enhancing structure 4 encapsulates the substrate 1, the first coil unit 2, and the second coil unit 3 such that the two terminal parts of each of the first pillars 231 of the first electrodes 23 and the second pillars 331 of the second electrodes 33 are exposed for external electrical connection.

The inductance-enhancing structure 4 fills the through hole 13 of the substrate 1, so as to further increase an area of contact of the first and second coil units 2, 3 with the inductance-enhancing structure 4. The inductance-enhancing structure 4 may be made of a magnetic material, and molded by hot-pressing or cold-pressing. An exemplary magnetic material may include, but is not limited to, a thermosetting polymer doped with a magnetic metal powder, such as an epoxy-based material doped with one of chromium nickel silicon, iron carbonyl, and a combination thereof.

In use, when the first coil unit 2 is electrically connected to an external power supply through the first electrodes 23 and an electrical current flows through the first upper and lower coils 21, 22, a first inductance would be generated by the first coil unit 2 due to mutual inductance between the first upper and lower coils 21, 22 based on electromagnetic induction and inductive coupling. Likewise, when the second coil unit 3 is electrically connected to an external power supply through the second electrodes 33 and an electrical current flows through the second upper and lower coils 31, 32, a second inductance would be generated by the second coil unit 3 due to mutual induction between the second upper and lower coils 31, 32 based on electromagnetic induction and inductive coupling. Meanwhile, the inductance-enhancing structure 4 is configured to enhance the first and second inductances thus generated so as to form a desired improved inductance.

By arranging the first and second coil units 2, 3 through bifilar winding, the total area occupied by the first and second coil units 2, 3 on the substrate 1 of the thin-film inductor device may be effectively reduced, e.g., to approximately 1.2 $mm^2$. In contrast, the total area occupied by the coil units in a conventional thin-film inductor device may be 1.6 $mm^2$ in order to generate an inductance equal to that generated by the thin-film inductor device of the disclosure, indicating that at least ¼ of the area of the thin-film inductor device according to this disclosure can be saved without interfering the inductance to be generated. That is to say, if the thin-film inductor device of this disclosure has an area occupied by first and second coil units 2, 3 equal to that of the conventional thin-film inductor device, the thin-film inductor device of this disclosure can provide more free space for further disposition of, e.g., coil units (e.g., with more turns), so as to generate a larger inductance as compared to the conventional thin-film inductor device.

Figure 3:
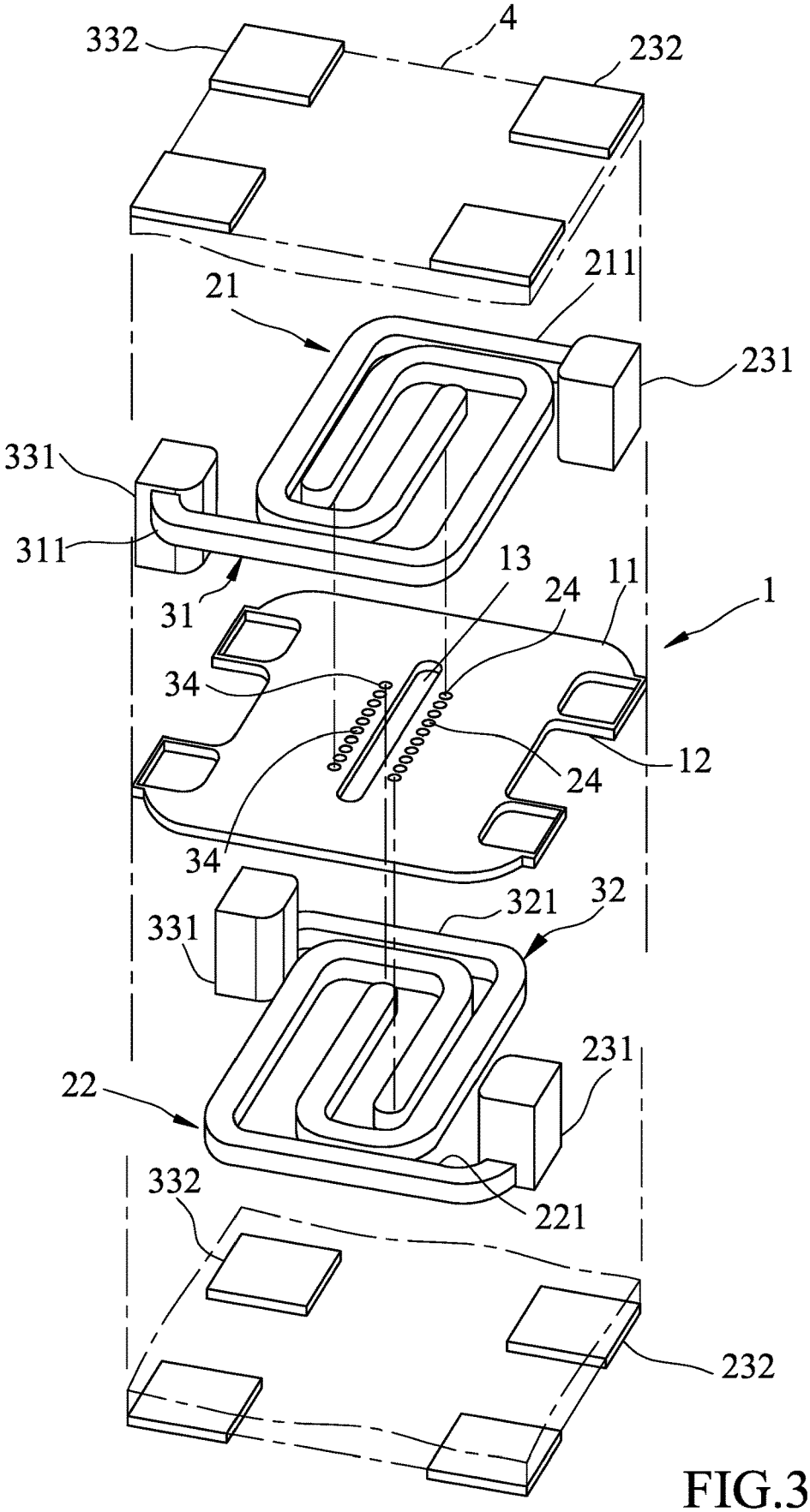
FIG. 3 is an exploded perspective view of a second embodiment of the thin-film inductor device according to the disclosure.

Referring to FIG. 3, a second embodiment of the thin-film inductor device according to the disclosure is similar to the first embodiment except that in the second embodiment, the first coil unit 2 further includes at least one first conducting member 24 which penetrates the substrate 1 and electrically connects to the first upper and lower coils 21, 22. As such, the first upper and lower coils 21, 22, which are electrically connected to each other, can serve as a single coil. Similarly, the second coil unit 3 of the second embodiment further includes at least one second conducting member 34 which penetrates the substrate 1 and electrically connects to the second upper and lower coils 31, 32. As such, the second upper and lower coils 31, 32, which are connected to each other, can serve as a single coil. That is, the first and second coil units 2, 3 may be seen as two coils that are disposed spacedly and arranged by bifilar winding.

When the first and second coil units 2, 3 are electrically connected to the external power supply through the first and second electrodes 23, 33, the first coil unit 2 is capable of generating the first inductance by self-inductance of the first upper and lower coils 21, 22 due to electromagnetic induction, and the second coil unit 3 is capable of generating the second inductance by self-inductance of the second upper and lower coils 31, 32 due to electromagnetic induction.

Similar to the first embodiment, the inductance-enhancing structure 4 can enhance the resultant first inductance and the second inductance to obtain an improved inductance.

In sum, by arranging the first and second upper coils 21, 32 and the first and second lower coils 22, 32 using bifilar winding, a total area occupied by the first and second coil units 2, 3 on the substrate 1 of the thin-film inductor device of this disclosure can be reduced, and therefore miniaturization of the thin-film inductor device can be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A thin-film inductor device, comprising:

a substrate which is made of an electrically insulating material, and which has opposite upper and lower surfaces;

a first coil unit which is made of an electrically conductive material, and which includes a first upper coil formed on said upper surface of said substrate, and said first upper coil being continuously and spirally wound to form a first spiral gap, a first lower coil formed on said lower surface of said substrate, and said first lower coil being continuously and spirally wound to form a second spiral gap, and two first electrodes spaced apart from each other, and electrically connecting to said first upper and lower coils, respectively;

a second coil unit which is made of an electrically conductive material, and which includes a second upper coil formed on said upper surface of said substrate, said second upper coil being fitted in said first spiral gap and extending along said first spiral gap, and said second upper coil and said first upper coil being disposed spacedly and arranged by bifilar winding, a second lower coil formed on said lower surface of said substrate, said second upper coil being fitted in said second spiral gap and extending along said second spiral gap, and said second lower coil and said first lower coil being disposed spacedly and arranged by bifilar winding, and two second electrodes spaced apart from each other, and electrically connecting to said second upper and lower coils, respectively; and an inductance-enhancing structure which encapsulates said substrate, said first coil unit, and said second coil unit such that two terminal parts of each of said first electrodes and said second electrodes are exposed for external electrical connection.

2. The thin-film inductor device according to claim 1, wherein each of said first electrodes includes a first pillar that penetrates said substrate, and that has said two terminal parts.

3. The thin-film inductor device according to claim 2, wherein each of said first electrodes further includes two first connection ports that are respectively disposed on and electrically connected to said two terminal parts of said first pillar.

4. The thin-film inductor device according to claim 2, wherein one of said first pillars is connected to a terminal end portion of said first upper coil, and the other one of said first pillars is connected to a terminal end portion of said first lower coil.

5. The thin-film inductor device according to claim 1, wherein each of said second electrodes includes a second pillar that penetrates said substrate, and that has said two terminal parts.

6. The thin-film inductor device according to claim 5, wherein each of said second electrodes further includes two second connection ports that are respectively disposed on and electrically connected to said two terminal parts of said second pillar.

7. The thin-film inductor device according to claim 5, wherein one of said second pillars is connected to a terminal end portion of said second upper coil, and the other one of said second pillars is connected to a terminal end portion of said second lower coil.

8. The thin-film inductor device according to claim 1, wherein said first coil unit further includes at least one first conducting member which penetrates said substrate and electrically connects to said first upper and lower coils.

9. The thin-film inductor device according to claim 1, wherein said second coil unit further includes a second conducting member that penetrates said substrate and electrically connects to said second upper and lower coils.

10. The thin-film inductor device according to claim 1, wherein said substrate is formed with at least one through hole, and said inductance-enhancing structure fills said at least one through hole.

11. The thin-film inductor device according to claim 1, wherein said inductance-enhancing structure is made of a magnetic material.

12. The thin-film inductor device according to claim 11, wherein said magnetic material includes a thermosetting polymer doped with a magnetic metal powder.

13. The thin-film inductor device according to claim 1, wherein each of said first upper and lower coils has a width ranging from 5 μm to 150 μm, and a thickness ranging from 10 μm to 200 μm.

14. The thin-film inductor device according to claim 1, wherein each of said second upper and lower coils has a width ranging from 5 μm to 150 μm, and a thickness ranging from 10 μm to 200 μm.

15. The thin-film inductor device according to claim 1, wherein one of said first upper and lower coils is wound in a clockwise direction starting from the first electrode, and the other one of said first upper and lower coils is wound in a counterclockwise direction.

16. The thin-film inductor device according to claim 1, wherein one of said second upper and lower coils is wound in a clockwise direction starting from the second electrode, and the other one of said second upper and lower coils is wound in a counterclockwise direction.

17. The thin-film inductor device according to claim 1, wherein a projection of said first upper coil on said substrate is a mirror image of a projection of said second lower coil on said substrate.

18. The thin-film inductor device according to claim 1, wherein a projection of said first lower coil on said substrate is a mirror image of a projection of said second upper coil on said substrate.

19. The thin-film inductor device according to claim 1, wherein said substrate is formed with two recesses extending inwardly from two opposite sides of said substrate, said first electrodes are located at two opposite sides of one of said recesses, and said second electrodes are located at two opposite sides of the other one of said recesses.

20. The thin-film inductor device according to claim 19, wherein said first upper coil and said second upper coil are alternately arranged along a direction from said one of said recesses to the other one of said recesses, and said first lower coil and said second lower coil are alternately arranged along said direction.

* * * * *